US010827562B2

(12) United States Patent
Ao

(10) Patent No.: US 10,827,562 B2
(45) Date of Patent: Nov. 3, 2020

(54) HEAT SENSITIVE ELECTRICAL SAFETY DEVICE

(71) Applicant: Albert Chi Man Ao, Chino Hills, CA (US)

(72) Inventor: Albert Chi Man Ao, Chino Hills, CA (US)

( * ) Notice: Subject to any disclaimer, the term of this patent is extended or adjusted under 35 U.S.C. 154(b) by 163 days.

(21) Appl. No.: 15/840,306

(22) Filed: Dec. 13, 2017

(65) Prior Publication Data

US 2019/0182904 A1 Jun. 13, 2019

(51) Int. Cl.

| | |
|---|---|
| ***H05B 1/02*** | (2006.01) |
| ***H01H 1/50*** | (2006.01) |
| ***H05B 3/34*** | (2006.01) |
| ***H01H 37/14*** | (2006.01) |
| ***H05B 3/56*** | (2006.01) |
| ***H01H 37/42*** | (2006.01) |
| *H01H 37/76* | (2006.01) |
| *H01H 71/16* | (2006.01) |
| *H01H 37/52* | (2006.01) |

(52) U.S. Cl.

CPC ..... *H05B 1/0252* (2013.01); *H01H 1/504* (2013.01); *H01H 37/14* (2013.01); *H01H 37/42* (2013.01); *H05B 3/34* (2013.01); *H05B 3/56* (2013.01); *H01H 37/52* (2013.01); *H01H 37/761* (2013.01); *H01H 71/164* (2013.01); *H05B 1/0208* (2013.01); *H05B 1/0213* (2013.01); *H05B 2203/014* (2013.01); *H05B 2203/02* (2013.01); *H05B 2203/035* (2013.01)

(58) Field of Classification Search

CPC ..... H05B 1/02; H05B 1/0202; H05B 1/0208; H05B 1/0213

USPC ..... 401/481

See application file for complete search history.

(56) References Cited

U.S. PATENT DOCUMENTS

| | | | |
|---|---|---|---|
| 8,519,816 | B2 | 8/2013 | Takeda |
| 2006/0109074 | A1 | 5/2006 | Lee et al. |
| 2010/0194286 | A1 | 8/2010 | Janning |

*Primary Examiner* — David J Walczak

*Assistant Examiner* — Joshua R Wiljanen

(74) *Attorney, Agent, or Firm* — ScienBiziP, P.C.

(57) ABSTRACT

This disclosure relates to a heat sensitive electrical safety device with a manually resettable device and an automatically resettable fuse. The manually settable fuse prolongs the serviceable life of the automatically resettable fuse.

20 Claims, 5 Drawing Sheets

HEAT SENSITIVE ELECTRICAL SAFETY DEVICE

TECHNICAL FIELD

The present disclosure relates to a heat sensitive electrical safety device, specifically a heat sensitive electrical safety device with an automatically resettable device.

DESCRIPTION OF RELATED ART

Most currently available liquid-filled heat sensitive electrical safety devices are typically connected to a heat producing electrical device with an automatically resettable fuse that provides Positive Thermal Coefficient (PTC) self-hold functionality to protect against overcurrent faults in the circuitry of the heat producing electrical device. When the heat producing electrical device is used for an extended time, heat ventilation vents will eventually become blocked due to wear and tear, e.g. dust collection, thus inducing temperature rises within the heat producing electrical device. The internal temperature of the heat producing electrical device will continue to rise until the preset temperature within a heat sensitive electrical safety device is reached. At such point, the heat sensitive electrical safety device will automatically cut off power to the heat producing electrical device through the automatically resettable fuse. The automatically resettable fuse generally shorts the circuit or breaks a circuit path to the heat producing electrical device by removing a physical connection in the circuit between the apparatus and the power source. Upon a power disconnect to the heat producing electrical device, all operation of the apparatus ceases due to short circuiting, thus reducing heat generation within the heat producing electrical device. As the internal temperature of the heat producing electrical device gradually reduces to about or below the preset temperature in the heat sensitive electrical safety device, the automatically resettable fuse reestablishes power to the heat producing electrical device by completing the circuit once again, and heat begin to regenerate by the heat producing electrical device. As heat begins to regenerate, the automatically resettable fuse remains under a relatively higher temperature at this point in time as opposed to the fuse before use. Thus, the automatically resettable fuse is continuously under thermal strain without being able to return to a cooler temperature and strain-free condition, and after repeated use, the fuse may collect dust or particles that can cause excessive heat or even electrical spark upon completing the circuit, which can be a fire hazard. Thus, there is room for improvement in the art.

BRIEF DESCRIPTION OF THE DRAWINGS

Many aspects of the exemplary embodiments can be better understood with reference to the following drawings. The components in the drawings are not necessarily drawn to scale, the emphasis instead being placed upon clearly illustrating the principles of the exemplary embodiments. Moreover, in the drawings, like reference numerals designate corresponding portions throughout the several views.

DETAILED DESCRIPTION

Figure 1:
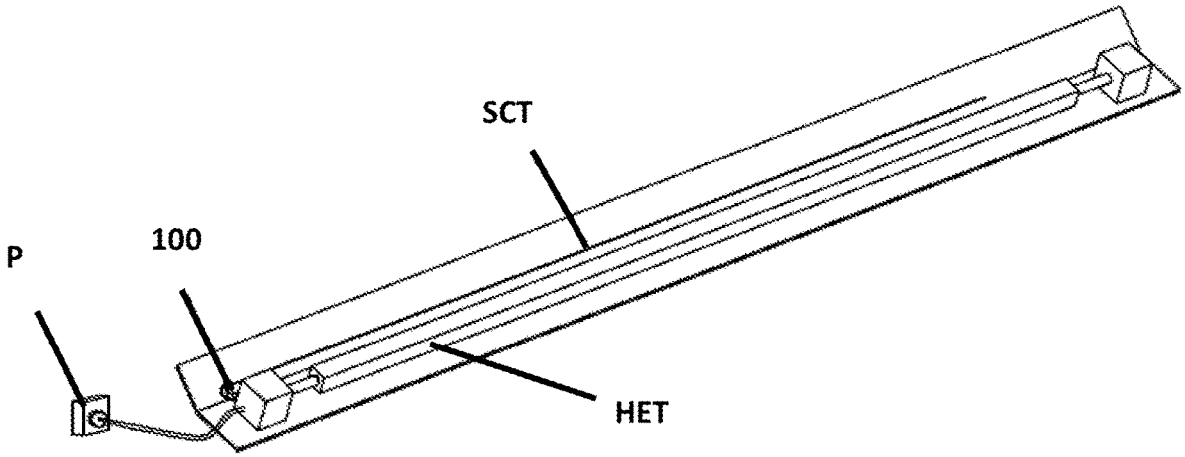
FIG. 1 is a schematic drawing illustrating a heat sensitive electrical safety device electrically coupled to a panel heating appliance in accordance to an exemplary embodiment of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale, and the proportions of certain portions may be exaggerated better illustrate details and features. The description is not to considered as limiting the scope of the exemplary embodiments described herein.

Several definitions that apply throughout this disclosure will now be presented. The term "coupled" is defined as connected, whether directly or indirectly through intervening components, and is not necessarily limited to physical connections. The connection can be such that the objects are permanently connected or detachably connected. The term "substantially" is defined to essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like. It should be noted that references to "an" or "one" exemplary embodiment in this disclosure are not necessarily to the same exemplary embodiment, and such references mean at least one.

References will now be made to the drawings to describe, in detail, various exemplary embodiments of the disclosure for realizing or improving a heat sensitive electrical safety device.

Figure 2:
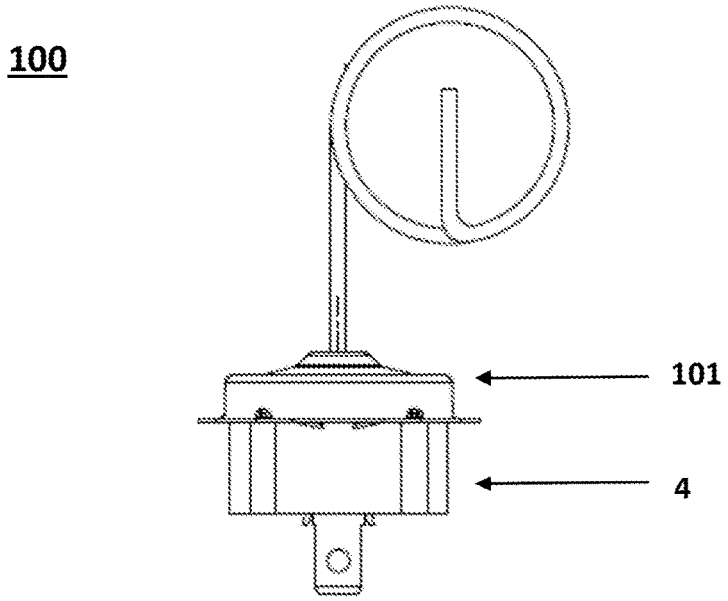
FIG. 2 is a schematic drawing illustrating the heat sensitive electrical safety device in accordance to the exemplary embodiment of the disclosure.
Figure 3A:
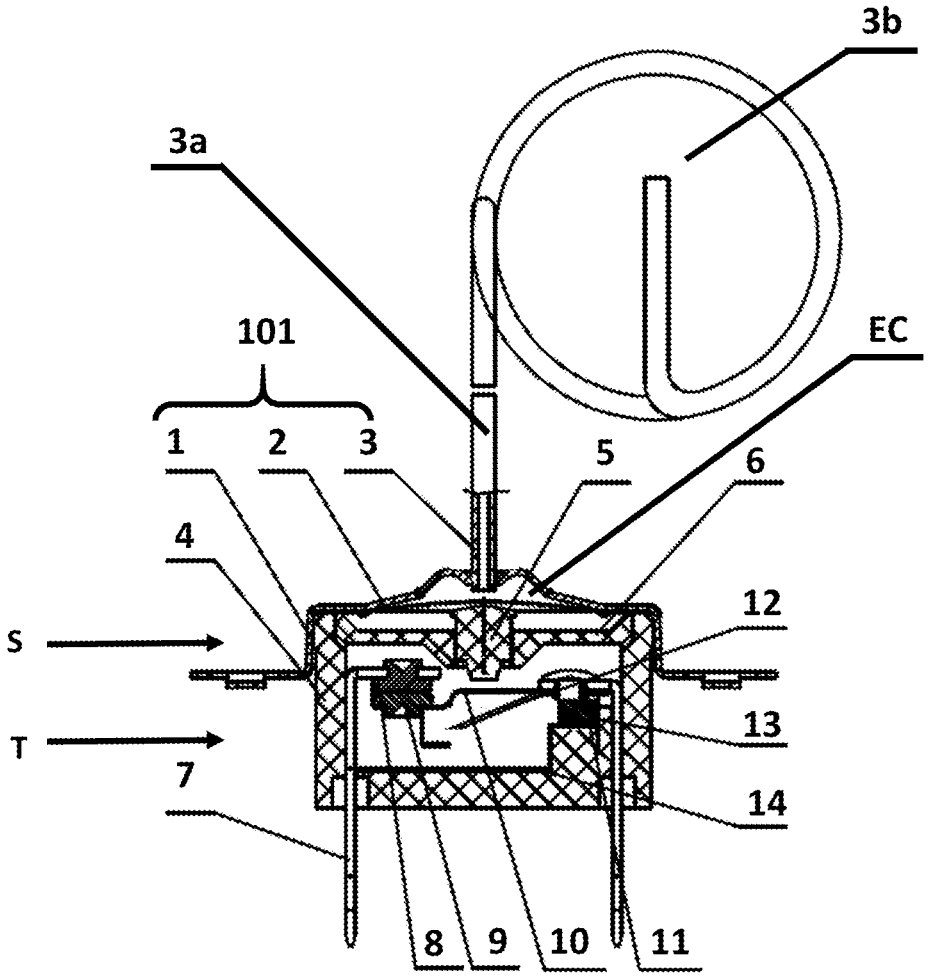
FIGS. 3*a* and 3*b* are cross-sectional views of the heat sensitive electrical safety device in accordance to the exemplary embodiment of the disclosure.

In FIG. 1, a heat sensitive electrical safety device 100 is provided in accordance with an exemplary embodiment of the disclosure. The heat sensitive electrical safety device 100 can be an electrical thermal limiter in compliance with the European Commission (EU) standards. When a power source, such as by use of an electrical plug P is supplied to an electrical appliance having a heating element tube HET, the electrical appliance typically generates heat during use. The electrical appliance can be any heat producing electrical device such as a heater, a computer processing unit, a vehicle, etc., but the disclosure is not limited to the exemplary embodiments provided herein. The heat sensitive electrical safety device 100 is electrically coupled between the heating element tube HET and the power source to protect against overcurrent faults through Positive Thermal Coefficient (PTC) self-hold function. Moreover, the heat sensitive electrical safety device 100 is thermally conductive to a temperature sensing copper tube SCT to accurately measure the ambient temperature in close proximity to the heating element tube HET as the heating element tube HET generates heat. In the exemplary embodiment, the heat sensitive electrical safety device 100 has a first temperature-sensitive control switch 101 and a second temperature-sensitive control switch 4 as shown in FIG. 2. The first temperature-sensitive control switch 101 includes a pressure variable head 101, and the pressure variable head 101 includes a cover 1, a membrane 2, and a capillary tube 3 as shown in FIG. 3*a*. The cover 1 is a thin piece of metal made by stamping. The cover 1 can be any metal material. In the exemplary embodiment, cover 1 may be stamped to a predetermined shape. An expandable chamber EC is defined between the cover 1, the membrane 2, and capillary tube 3 tube. The expandable chamber EC is filled with at least one thermally expandable fluid, preferably a liquid. The liquid can be any medium having thermally conducting properties, preferably a temperature sensitive liquid that can be vaporized at a predetermined temperature. The liquid can be water, alcohol, ethylene glycol, and other chemical agents having the predetermined temperature set as a boiling point in a range of about 80 to 150 degrees Celsius. The temperature sensitive liquid is not limited to the example provided herein. The capillary tube 3 has two ends, a temperature sensing end 3*a* thermally conductive to the temperature sensitive liquid within the expandable chamber EC and a sealed end 3*b* that is connected to the temperature sensing copper tube SCT. In the exemplary embodiment, the cover 1 is substantially dome-shaped. The shape of the cover 1 is not limited to the exemplary embodiments provided herein. The cover 1 has an aperture (not labeled) defined generally adjacent a geometrical center of the cover 1. The membrane 2 is an elastic and substantially conical member removably attached to a bottom surface of the cover 1. Preferably, the membrane 2 is tightly fitted with the cover 1 to create a liquid tight seal. The membrane 2 is concentric with the cover 1. The sealed end 3*b* of the capillary tube 3 is partially inserted through the aperture of the cover 1 to form a liquid tight fit therebetween. With the liquid tight fit between the cover 1, the membrane 2, and the capillary tube 3, a hermetic seal is formed to securely retain the temperature sensitive liquid within the expandable chamber EC.

Figure 3B:
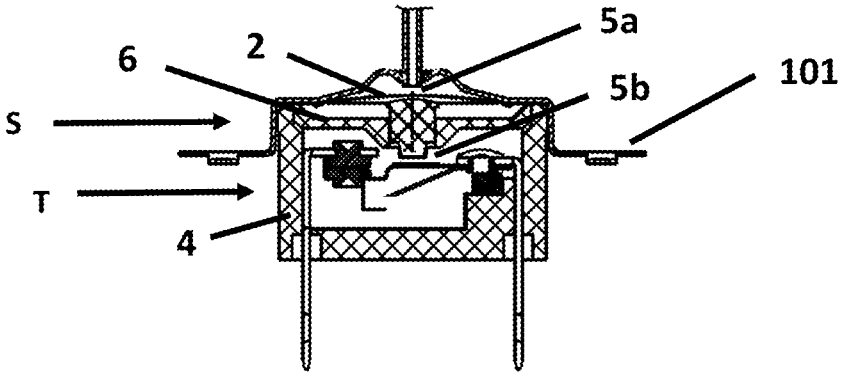

The second temperature-sensitive control switch 4 is an electrically insulating housing. Referring to FIG. 3*a*, the second temperature-sensitive control switch 4 has a temperature sensing end S and a terminal end T. The second temperature-sensitive control switch 4 includes a pin 5 and a guide 6. The pin 5 has two ends, a flat end 5*a* and a pointed end 5*b* as shown in FIG. 3*b*. The guide 6 is substantially an annular member having an aperture defined substantially at a geometric center thereof. The flat end 5*a* of the pin 5 is coupled to a bottom surface of the membrane 2 (expandable chamber EC) whereas the pointed end 5*b* of the pin 5 is inserted through the aperture of the guide 6 to guide movements of the pointed end 5*b* of the pin 5. The pin 5 and the guide 6 are arranged proximate to the temperature sensing end S of the second temperature-sensitive control switch 4. When the pressure variable head 101 is at the temperature sensing end S of the second temperature-sensitive control switch 4, the pressure variable head 101 forms an interference fit with the second temperature-sensitive control switch 4.

Figure 4:
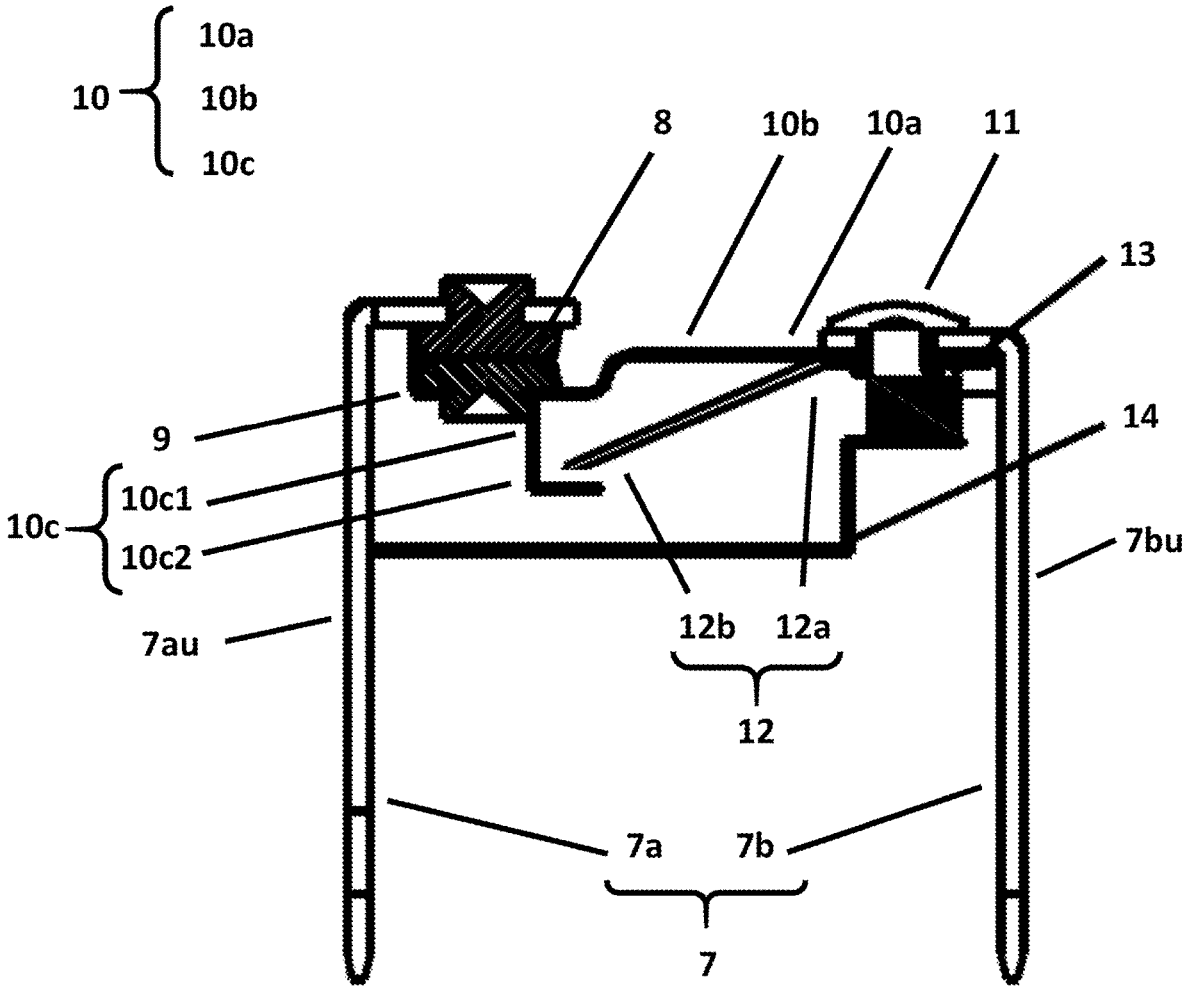
FIG. 4 is a cross-sectional view of a terminal with two terminal portions, a flat contact, a dome contact, a metallic blade, a rivet, a bimetal strip, and a PTC element of the heat sensitive electrical safety device in accordance to the exemplary embodiment of the disclosure.
Figure 5:
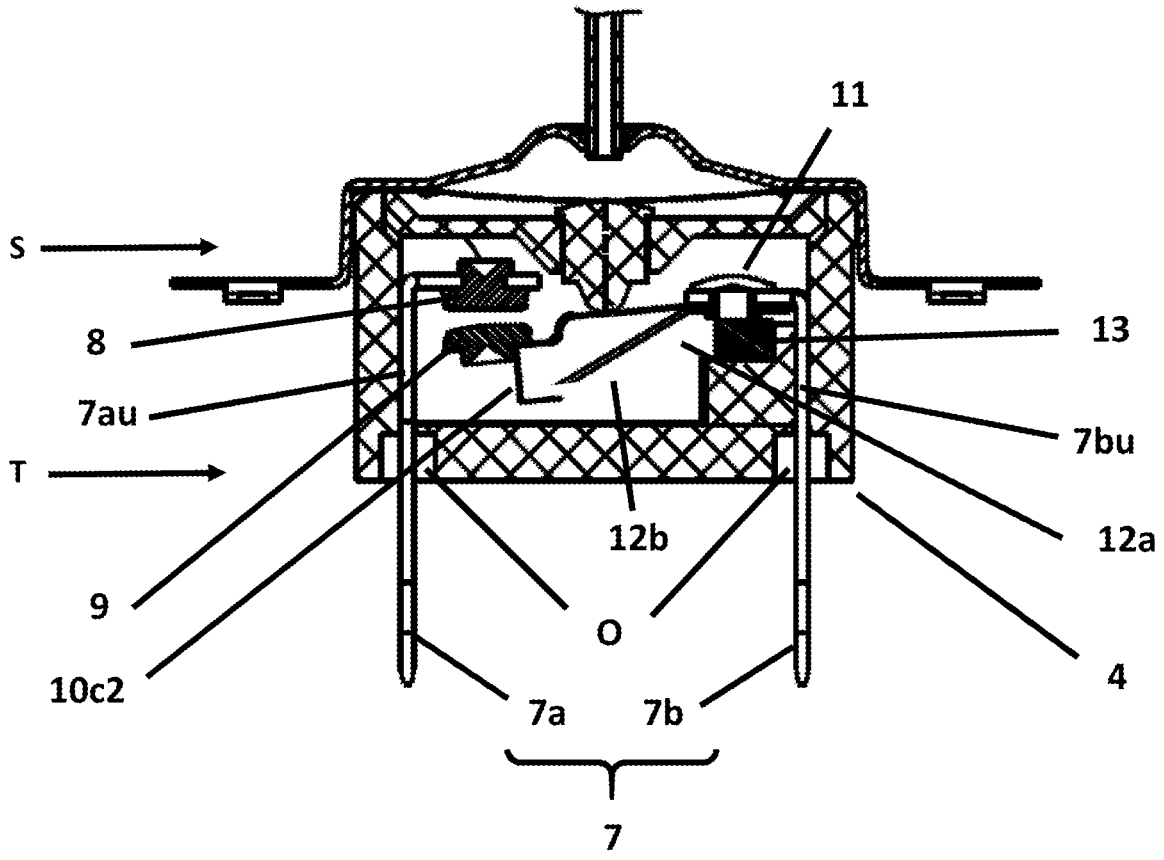
FIG. 5 is a schematic drawing of the heat sensitive electrical safety device in accordance to the exemplary embodiment of the disclosure.

Referring to FIG. 4, the heat sensitive electrical safety device 100 further includes a terminal 7 with two terminal portions 7*a* and 7*b*, a flat contact 8, a dome contact 9, a metallic blade 10, a rivet 11, a bimetal strip 12, and a positive thermal coefficient (PTC) element inside the enclosure between the pressure variable head 101 and the second temperature-sensitive control switch 4. The PTC element has a thermal coefficient in a range of 40-300 degrees $^{\circ}$ C.$^{-1}$, where the PTC element can heat up. The PTC element also has a thermal conductivity in a range of about 2.25 to 3.06 $Wm^{-1}K^{-1}$. The PTC element includes two electrodes 13, 14. The first electrode 13 is an anode (positive electrode) and the second electrode 14 is a cathode (negative electrode) in the exemplary embodiment. Referring to FIG. 5, the second temperature-sensitive control switch 4 further includes two openings O arranged proximate to the terminal end T of the second temperature-sensitive control switch 4. The two terminal portions 7*a*, 7*b* are spaced apart from one another and respectively pass though the two openings O of the second temperature-sensitive control switch 4 such that one end of each of the two terminal portions 7*a*, 7*b* is exposed from the second temperature-sensitive control switch 4. Two unexposed ends 7*au*, 7*bu* of two respective terminal portions 7*a*, 7*b* are arranged within the second temperature-sensitive control switch 4. One unexposed end 7*au* of a first terminal portion 7*a* is electrically coupled to the flat contact 8 whereas the other unexposed end 7*bu* of the second terminal portion 7*b* is electrically coupled between the rivet 11 and the first electrode 13 as shown in FIG. 5.

In the exemplary embodiment, the metallic blade 10 is made of a flexible and electrically conductive material. The metallic blade 10 has three portions, an anchor portion 10*a*, a beam portion 10*b*, and a retaining member 10*c* as shown in FIG. 4. The anchor portion 10*a* is physically and electrically coupled between the rivet 11 and the first electrode 13 acting as a pivot point such that the beam portion 10*b* and the retaining member 10*c* are cantilevered. The beam portion 10*b* extends from the anchor portion 10*a*. The retaining member 10*c*, substantially hook-shaped in the exemplary embodiment, is an extension of the beam portion 10*b*. The dome contact 9 is on and electrically coupled to the retaining member 10*c* at a contact end 10*c*1 of the retaining member 10*c* whereas the other end of the retaining member 10*c* is a free end 10*c*2. The dome contact 9 is electrically coupled with the flat contact 8 in normal operations of the heat sensitive electrical safety device 100.

The bimetal strip 12 is made of a flexible, thermally conductive, and electrically conductive material. The bimetal strip 12 has two ends, a fixed end 12*a* and a free end 12*b*. The fixed end 12*a* of the bimetal strip 12 is an electrically conductive member coupled between the rivet 11 and the first electrode 13. The bimetal strip 12 is also thermally coupled to the first electrode 13. The bimetal strip 12 has a predetermined temperature in the range of 100-400 degrees Celsius. The bimetal strip 12 is made of two layers of material, namely, a high expansion layer HES and a low expansion layer LES. The high expansion layer HES bends at a different temperature from the low expansion layer HES. The high expansion layer HES has a total mass composition comprising 9.00-11.00 mass % Nickel, ≤0.25 mass % Chromium, ≤1.00 mass % Iron, 71.00-73.00 mass % Manganese, 17.00-19.00 mass % Copper, ≤0.1 mass % Silicon, ≤0.025 mass % Sulfur, ≤0.025 mass % Phosphorus, and ≤0.1 mass % Carbon in the exemplary embodiment. The low expansion layer LES has a total mass composition 35.50-36.50 mass % Nickel, ≤0.50 mass % Chromium, trace amount of Iron, ≤0.05 mass % Manganese, ≤0.25 mass % Silicon, ≤0.12 mass % Carbon, ≤0.025 mass % Sulfur, ≤0.025 mass % Phosphorus, and ≤0.5 mass % Cobalt in the exemplary embodiment.

Since the unexposed end 7*au* of the first terminal portion 7*a* is electrically coupled to the flat contact 8 and the unexposed end 7*bu* of the second terminal portion 7*b* is electrically coupled between the rivet 11, the metallic blade 10, and the PTC element 13, 14, the two terminal portions 7*a*, 7*b*, the flat contact 8, the dome contact 9, the rivet 11, and the PTC element 13, 14 completes a circuit and conducts electrical current between the two terminal portions 7*a*. 7*b* when the terminal 7 is connected to a power source and a voltage is applied under normal operations as shown in FIG. 4. The bimetal strip 12 is thermally coupled to the first electrode 13 of the PTC element 13, 14. In the preferred exemplary embodiment, the bimetal strip 12 is also electrically coupled to the metallic blade 10, the rivet 11, the first electrode 13 and the second electrode 14, however, the bimetal strip 12 is not require to electrically couple to complete or closed the circuit between the two terminal portions 7*a*, 7*b*.

Referring to FIG. 1, the heat sensitive electrical safety device 100 is applied to the heating element tube HET as a protection against overcurrent fault. As the heating element tube HET generates heat due to its normal operations, the heat generated is transferred to the sensing element tube SCT. The heat is then transferred to the heat sensitive electrical safety device 100. Specifically, the heat generated is transferred to the heat sensitive electrical safety device 100 through the capillary tube 3 and the heat is further transferred from the capillary tube 3 into the liquid filled within the expandable chamber EC. Referring to FIG. 3*a* in conjunction with FIGS. 3*b* and 4, as the liquid within the expandable chamber EC rises in temperature, the liquid vaporizes under specific predetermined temperature and changes into a gas phase that increases the pressure inside the expandable chamber EC. The liquid has a boiling point in a range of 80 to 150 degrees Celsius. Preferably, the liquid in the exemplary embodiment has a boiling temperature of 150 degrees Celsius. When the pressure inside the expandable chamber EC increases and reaches a threshold pressure in a range of 2.5 $Kgf/Cm^2$-4.0 $Kgf/Cm^2$, portions of membrane 2 urges the pointed end 5*b* of pin 5 to apply a force onto the beam portion 10*b* of the metallic blade. As the pressure within the expandable chamber EC further rises, the expandable chamber EC further supplies the pin 5 with a greater force to push onto the beam portion 10*b* until the dome contact 9 on the retaining member 10*c* are physically separated from the flat contact 8 such that the circuit is incomplete or open, in other words, breaks the circuit path between the dome contact 9 and the flat contact 8 and opens the circuit, as shown in FIG. 5. At this point, current is no longer supplied to power the heating element tube HET, thus, the metallic blade 10, or the automatic resettable fuse, is activated to provide overcurrent fault protection to the heating element tube HET. Then, the electrical appliance having the heating element tube HET cease to operate and generate heat.

Figure 6:
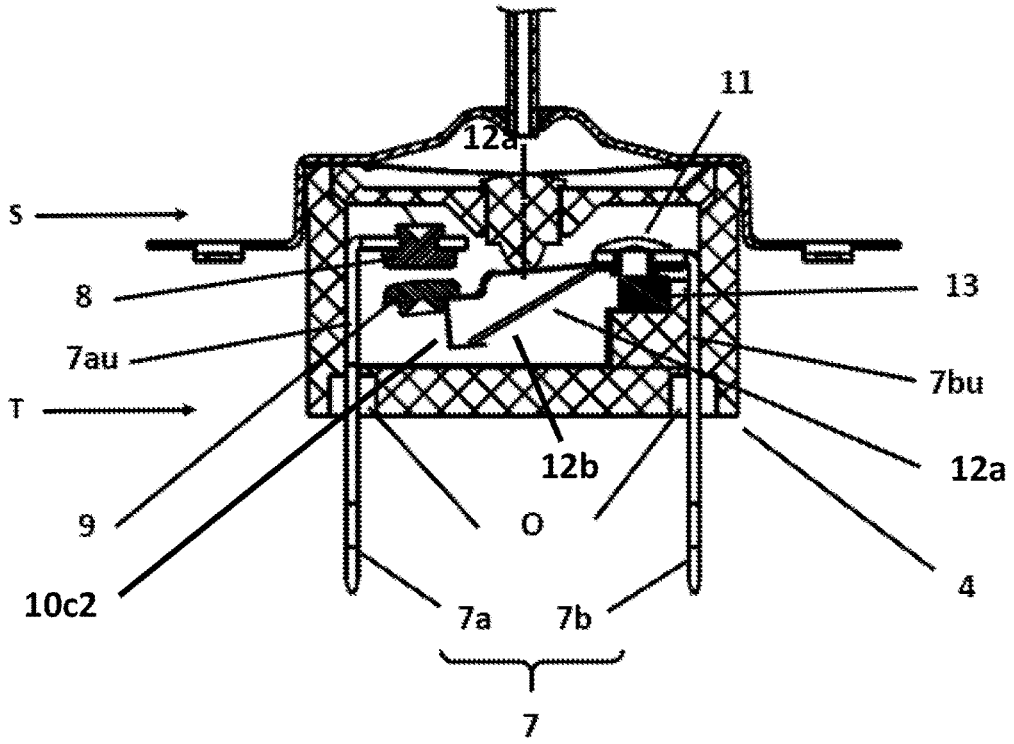
FIG. 6 is a schematic drawing of the heat sensitive electrical safety device in accordance to the exemplary embodiment of the disclosure.

However, the power source is still connected to the heat sensitive electrical safety device 100 through the two terminal portions 7*a*, 7*b*. Since the power source is still connected to the heat sensitive electrical safety device 100 through the two terminal portions 7*a*, 7*b*, electric current naturally flows through the only route available with the least resistance, which is through the second terminal portion 7*b*, the metallic blade 10, and the first electrode 13, and begins to heat up the first electrode 13. One of the characteristics of first electrode 13 is that as heat increases, resistance rapidly decreases to the range of milli-ohms, which dramatically and rapidly increases temperature of the first electrode 13 even more, which rapidly generates a substantial amount of heat. As the first electrode 13 heats up, the bimetal strip 12 (manually resettable device), which is thermally coupled to the first electrode 13, also heats up, reaches a predetermined temperature, and begins to bend. Specifically, the free end 12*b* of the bimetal strip 12 bends away from its original position to press against the free end 10*c*2 of the metallic blade 10 (automatically resettable fuse) as shown in FIG. 6 and retains the disengaged positions between the flat contact 8 from the dome contact 9, thus, the flat contact 8 and the dome contact 9 remain to be electrically decoupled from each other at this point. In other words, the circuit continues to be opened.

When the plug P is removed from the heat sensitive electrical safety device 100, for example, when a user removes the plug P from the power source, current can no longer pass through the first electrode 13 and the bimetal strip 12. At such time, the first electrode 13 and the bimetal strip 12 (manually resettable device) begin to cool down to below a predetermined temperature or reset to the respective original positions, the bimetal strip 12 can bend in a direction towards its original position. If the plug P is removed and the pressure inside the expandable chamber EC also drops to a certain point where the expansion of gas within the expandable chamber EC no longer supplies a force to the pin 5 that is sufficient to press against the beam portion 10*b*, the flat contact 8 and the dome contact 9 can then be electrically coupled as shown in FIG. 4, thus the circuit is once again completed or closed. Notably, if the power source is not removed from the heat sensitive electrical safety device 100 after the metallic blade 10 (automatically resettable fuse) is activated, even if the pressure inside the expandable chamber EC eventually drops to a certain point where a force is no longer supplied to press the pin 5 press against the beam portion 10*b* of the metallic blade 10, the flat contact 8 and the dome contact 9 are still retained in an electrically decoupled state since the bimetal strip 12 (manually resettable device) still retains the open circuit between the flat contact 8 and the dome contact 9.

By the combination of the metallic blade 10 (automatic resettable fuse), the bimetal strip 12 (manually resettable device), and the first electrode 13 in the disclosure, the dome contact 9 and the flat contact 8 are retained in an electrically incomplete or open state from each other even after the metallic blade 10 automatically resets. The continuous electrical disconnect between the dome contact 9 and the flat contact 8, even after the metallic blade 10 automatically resets, provides a prolonged period of time sufficient to allow a longer cool down period for the metallic blade 10 (automatic resettable fuse) before the metallic blade 10 resets and once again completes or closes the circuit to the heat sensitive electrical safety device 100. When the heat sensitive electrical safety device 100 is completely and manually removed from power, for example, the plug P being removed from a power source, the bimetal strip 12 (manually resettable device) is cooled and reset to the predetermined temperature. Thus, prolonged thermal strain induced onto the metallic blade 10 (automatically resettable fuse) is reduced, the serviceable life of metallic blade 10 is prolonged, as well as the occurrence of a fire hazard is significantly reduced.

It is to be understood that the above-described exemplary embodiments are intended to illustrate rather than limit the disclosure. Any elements described in accordance with any exemplary embodiments is understood that they can be used in addition or substituted in other exemplary embodiments. Exemplary embodiments can also be used together. Variations may be made to the exemplary embodiments without departing from the spirit of the disclosure. The above-described exemplary embodiments illustrate the scope of the disclosure but do not restrict the scope of the disclosure.

Depending on the exemplary embodiment, certain steps of the methods described may be removed, others may be added, and the sequence of steps may be altered. It is also to be understood that the description and the claims drawn to a method may include some indication in reference to certain steps. However, the indication used only serves as identification purposes and not as a suggestion as to an order for the steps.

What is claimed is:

1. A heat sensitive electrical safety device for use with a heat producing electrical device, comprising:

a first temperature-sensitive control switch, the first temperature-sensitive control switch including a pressure variable head; and a second temperature-sensitive control switch including a metallic blade, a bimetal strip, and a control circuit, the control circuit being normally closed through the metallic blade, and the second temperature-sensitive control switch being in physical contact with the first temperature-sensitive control switch;

wherein when a temperature of the heat producing electrical device exceeds a first predetermined temperature, the pressure variable head of the first temperature-sensitive control switch increases in pressure and applies a contact force to the metallic blade to break a circuit path of the normally closed control circuit;

wherein when the circuit path is broken, the control circuit is configured to continue receiving electric current through the bimetal strip and causing the bimetal strip to be heated, and when the heated bimetal strip reaches a second predetermined temperature, the heated bimetal strip being configured to retain the breaking of the control circuit even after the heat producing electrical device returns to below the first predetermined temperature and allowing the pressure in the pressure variable head to decrease; and wherein when a temperature of the bimetal strip is below the second predetermined temperature, the bimetal strip returns to a configuration closing the control circuit.

2. The device of claim 1, wherein the pressure variable head further comprising:

an expandable chamber filled with a thermally expandable fluid and in thermal contact with the heat producing electrical device;

wherein when a temperature of the fluid exceeds a third predetermined temperature, the fluid in the expandable chamber expands, causing the pressure variable head to increase in pressure and apply the contact force to the metallic blade, thereby breaking the circuit path of the control circuit, and wherein the third predetermined temperature being less than the first predetermined temperature.

3. The device of claim 2, wherein:

the pressure variable head further comprising:

a cover;

a membrane; and a capillary tube;

wherein the cover, the membrane, and the capillary tube cooperatively define the expandable chamber; and wherein the thermally expandable fluid comprises a liquid; and wherein the second temperature-sensitive control switch further comprising:

a pin having a flat end and a pointed end, the expandable chamber being in direct contact with the second temperature-sensitive control switch through the flat end of the pin;

a guide defining an aperture, the pointed end of the pin partially inserted through the aperture;

a terminal;

a flat contact;

a dome contact;

a rivet; and a positive temperature coefficient (PTC) element;

wherein the terminal has a first terminal portion and a second terminal portion;

wherein the flat contact is on and electrically coupled to the first terminal portion;

wherein the PTC element has a first electrode and a second electrode, the first and the second electrodes are electrically coupled to each other;

wherein the bimetal strip has a fixed end and a free end, and the fixed end of the bimetal strip is thermally and electrically coupled to the first electrode of the PTC element;

wherein the rivet physically and electrically couples the metallic blade and the second terminal portion to the first electrode;

wherein the dome contact is on and electrically coupled to the metallic blade;

wherein the second electrode is electrically coupled between the first electrode and the first terminal portion; and wherein the terminal, the flat contact, the dome contact, the metallic blade, and the PTC element are configured for closing the control circuit; and wherein when the temperature of the liquid exceeds the third predetermined temperature, the expanding liquid causes the expandable chamber to expand and apply the contact force to the flat end of the pin, pressing the pointed end of the pin against the metallic blade to break the circuit path of the normally closed control circuit, and the circuit path being between the flat contact and the dome contact.

4. The device of claim 3, wherein:

the capillary tube is thermally conductive with the liquid in the expandable chamber;

wherein the metallic blade further comprising:

a retaining member having a fixed end and a free end;

an anchor portion, the rivet physically and electrically couples the anchor portion of metallic blade and the second terminal portion to the first electrode; and a beam portion extending from the anchor portion, and the retaining member extending from the beam portion; and wherein the pointed end of the pin presses against the beam portion of the metallic blade to break the circuit path between the flat contact and the dome contact when the temperature of the liquid exceeds the third predetermined temperature.

5. The device of claim 3, wherein when the circuit path is broken, the control circuit is further configured to continue receiving electric current through the PTC element and heat up the PTC element; and wherein the PTC element thermally coupled to the bimetal strip, upon receiving current, is heated along with the bimetal strip and causes the heated bimetal strip to bend towards, press against, and retain the metallic blade at a position such that the circuit path continues to break between the flat contact and the domed contact even after the heat producing electrical device returns to below the first predetermined temperature and allowing the pressure in the pressure variable head to decrease.

6. The device of claim 5, wherein when the temperature of the bimetal strip is below the second predetermined temperature, the bimetal strip bends away from the metallic blade and allows the circuit path to be closed between the flat contact and the dome contact, thereby closing the control circuit.

7. The device of claim 6, wherein the bimetal strip is a material selected from a group consisting of Manganese, Copper, Nickel, Chromium, Iron, Silicon, Sulfur, Phosphorus, Carbon, and a combination thereof; wherein the bimetal strip is configured to move and retain the breaking of the circuit path to the normally closed control circuit at or exceed the second predetermined temperature, the second predetermined temperature is in a range of about 100-about 400 degrees Celsius.

8. The device of claim 7, wherein:

the bimetal strip comprises a first metallic layer and a second metallic layer, one of the two layers comprises a high expansion layer (HES) and the other of the two layers comprises a low expansion layer (LES);

wherein the HES layer has a total mass composition comprising: 9.00-11.00 mass % Nickel, ≤0.25 mass % Chromium, ≤1.00 mass % Iron, 71.00-73.00 mass % Manganese, 17.00-19.00 mass % Copper, ≤0.1 mass % Silicon, ≤0.025 mass % Sulfur, ≤0.025 mass % Phosphorus, and ≤0.1 mass % Carbon; and wherein the LES layer has a total mass composition comprising: 35.50-36.50 mass % Nickel, ≤0.50 mass % Chromium, trace amount of Iron, ≤0.05 mass % Manganese, ≤0.25 mass % Silicon, ≤0.12 mass % Carbon, ≤0.025 mass % Sulfur, ≤0.025 mass % Phosphorus, and ≤0.5 mass % Cobalt.

9. The device of claim 5, wherein the PTC element has a thermal coefficient in a range of about 40 to about 300 degrees ° $C.^{-1}$.

10. The device of claim 3, wherein the third predetermined temperature of the liquid is in a range of about 80 to about 150 degrees Celsius.

11. A method for using a heat sensitive electrical safety device with a heat producing electrical device, the method comprising:

providing the heat sensitive electrical safety device comprising:

a first temperature-sensitive control switch, the first temperature-sensitive control switch including a pressure variable head; and a second temperature-sensitive control switch including a metallic blade, a bimetal strip, and a control circuit, the control circuit being normally closed through the metallic blade, and the second temperature-sensitive control switch being in physical contact with the first temperature-sensitive control switch;

wherein when a temperature of the heat producing electrical device exceeds a first predetermined temperature, the pressure variable head of the first temperature-sensitive control switch increases in pressure and applies a contact force to the metallic blade to break a circuit path of the normally closed control circuit;

wherein when the circuit path is broken, the control circuit is configured to continue receiving electric current through the bimetal strip and causing the bimetal strip to be heated, and when the heated bimetal strip reaches a second predetermined temperature, the heated bimetal strip being configured to retain the breaking of the control circuit even after the heat producing electrical device returns to below the first predetermined temperature and allowing the pressure in the pressure variable head to decrease; and wherein when a temperature of the bimetal strip is below the second predetermined temperature, the bimetal strip returns to a configuration closing the control circuit.

12. The method of claim 11, wherein the pressure variable head further comprising:

an expandable chamber filled with a thermally expandable fluid and in thermal contact with the heat producing electrical device;

wherein when a temperature of the fluid exceeds a third predetermined temperature, the fluid in the expandable chamber expands, causing the pressure variable head to increase in pressure and apply the contact force to the metallic blade, thereby breaking the circuit path of the control circuit, and wherein the third predetermined temperature being less than the first predetermined temperature.

13. The method of claim 12, wherein:

the pressure variable head further comprising:

a cover;

a membrane; and a capillary tube;

wherein the cover, the membrane, and the capillary tube cooperatively define the expandable chamber; and wherein the thermally expandable fluid comprises a liquid; and wherein the second temperature-sensitive control switch further comprising:

a pin having a flat end and a pointed end, the expandable chamber being in direct contact with the second temperature-sensitive control switch through the flat end of the pin;

a guide defining an aperture, the pointed end of the pin partially inserted through the aperture;

a terminal;

a flat contact;

a dome contact;

a rivet; and a positive temperature coefficient (PTC) element;

wherein the terminal has a first terminal portion and a second terminal portion;

wherein the flat contact is on and electrically coupled to the first terminal portion;

wherein the PTC element has a first electrode and a second electrode, the first and the second electrodes are electrically coupled to each other;

wherein the bimetal strip has a fixed end and a free end, and the fixed end of the bimetal strip is thermally and electrically coupled to the first electrode of the PTC element;

wherein the rivet physically and electrically couples the metallic blade and the second terminal portion to the first electrode;

wherein the dome contact is on and electrically coupled to the metallic blade;

wherein the second electrode is electrically coupled between the first electrode and the first terminal portion; and wherein the terminal, the flat contact, the dome contact, the metallic blade, and the PTC element are configured for closing the control circuit; and wherein when the temperature of the liquid exceeds the third predetermined temperature, the expanding liquid causes the expandable chamber to expand and apply the contact force to the flat end of the pin, pressing the pointed end of the pin against the metallic blade to break the circuit path of the normally closed control circuit, and the circuit path being between the flat contact and the dome contact.

14. The method of claim 13, wherein:

the capillary tube is thermally conductive with the liquid in the expandable chamber;

wherein the metallic blade further comprising:

a retaining member having a fixed end and a free end;

an anchor portion, the rivet physically and electrically couples the anchor portion of metallic blade and the second terminal portion to the first electrode; and a beam portion extending from the anchor portion, and the retaining member extending from the beam portion; and wherein the pointed end of the pin presses against the beam portion of the metallic blade to break the circuit path between the flat contact and the dome contact when the temperature of the liquid exceeds the third predetermined temperature.

15. The method of claim 13, wherein when the circuit path is broken, the control circuit is further configured to continue receiving electric current through the PTC element and heat up the PTC element; and wherein the PTC element thermally coupled to the bimetal strip, upon receiving current, is heated along with the bimetal strip and causes the heated bimetal strip to bend towards, press against, and retain the metallic blade at a position such that the circuit path continues to break between the flat contact and the domed contact even after the heat producing electrical device returns to below the first predetermined temperature and allowing the pressure in the pressure variable head to decrease.

16. The method of claim 15, wherein when the temperature of the bimetal strip is below the second predetermined temperature, the bimetal strip bends away from the metallic blade and allows the circuit path to be closed between the flat contact and the dome contact, thereby closing the control circuit.

17. The method of claim 16, wherein the bimetal strip is a material selected from a group consisting of Manganese, Copper, Nickel, Chromium, Iron, Silicon, Sulfur, Phosphorus, Carbon, and a combination thereof; wherein the bimetal strip is configured to move and retain the breaking of the circuit path to the normally closed control circuit at or exceed the second predetermined temperature, the second predetermined temperature is in a range of about 100-about 400 degrees Celsius.

18. The method of claim 17, wherein:

the bimetal strip comprises a first metallic layer and a second metallic layer, one of the two layers comprises a high expansion layer (HES) and the other of the two layers comprises a low expansion layer (LES);

wherein the HES layer has a total mass composition comprising: 9.00-11.00 mass % Nickel, ≤0.25 mass % Chromium, ≤1.00 mass % Iron, 71.00-73.00 mass % Manganese, 17.00-19.00 mass % Copper, ≤0.1 mass % Silicon, ≤0.025 mass % Sulfur, ≤0.025 mass % Phosphorus, and ≤0.1 mass % Carbon; and wherein the LES layer has a total mass composition comprising: 35.50-36.50 mass % Nickel, ≤0.50 mass % Chromium, trace amount of Iron, ≤0.05 mass % Manganese, ≤0.25 mass % Silicon, ≤0.12 mass % Carbon, ≤0.025 mass % Sulfur, ≤0.025 mass % Phosphorus, and ≤0.5 mass % Cobalt.

19. The method of claim 15, wherein the PTC element has a thermal coefficient in a range of about 40 to about 300 degrees $^{\circ}$ C.$^{-1}$.

20. The method of claim 13, wherein the third predetermined temperature of the liquid is in a range of about 80 to about 150 degrees Celsius.

* * * * *